United States Patent [19]

Schippers

[11] Patent Number: 4,817,529

[45] Date of Patent: Apr. 4, 1989

[54] PROCESS AND APPARATUS FOR AUTOMATICALLY POSITIONING AN EXPLOSIVE CHARGE ABOVE THE SURFACE OF SNOW

[76] Inventor: Jacob Schippers, Quartier Le Bresson, 38660 Le Touvet, France

[21] Appl. No.: 63,010

[22] Filed: Jun. 17, 1987

[30] Foreign Application Priority Data

Jun. 17, 1986 [FR] France ..... 86 08825

[51] Int. Cl.[4] ..... F42D 3/00

[52] U.S. Cl. ..... 102/302; 102/200; 86/20.15; 37/201

[58] Field of Search ..... 102/200, 302; 86/20.15; 37/201

[56] References Cited

U.S. PATENT DOCUMENTS 281,495 7/1883 Gunther ..... 37/201

3,600,116 8/1971 Clark, Jr. et al. ..... 37/201 X

FOREIGN PATENT DOCUMENTS 2561837 9/1985 France .

0609450 2/1979 Switzerland .

8001511 1/1979 World Int. Prop. O. .

*Primary Examiner*—Peter A. Nelson

*Attorney, Agent, or Firm*—Sandler & Greenblum

[57] ABSTRACT

A process and an apparatus for automatically positioning an explosive charge at a predetermined position above the surface of the snow for setting off an avalanche.

The apparatus includes an electric winch for unwinding and rewinding a suspension string attached to the explosive charge. The winch is swingably mounted in a container of the apparatus in a manner so as to oscillate between up and down positions depending upon whether the string is tensioned or not. Magnetic detectors associated with the winch count and signal the number of turns of its drum to a programmable electronic unit. Coded wheels are provided to select a maximum height of descent and a lifting height for the charge after contact with the snow.

37 Claims, 1 Drawing Sheet

PROCESS AND APPARATUS FOR AUTOMATICALLY POSITIONING AN EXPLOSIVE CHARGE ABOVE THE SURFACE OF SNOW

FIELD OF THE INVENTION

The present invention relates to a process for automatically positioning an explosive charge at a predetermined height above the surface of the snow for set-off an avalanche, in which one brings the charge above the selected point by means of a cable transport apparatus, and one performs a programmed descent of the charge by means of a suspension mechanism by unwinding a predetermined length of a flexible suspension element connected with the charge.

The invention likewise relates to an apparatus for positioning explosive charges for setting off avalanches, which apparatus includes:

(a) a container carried by a cable transport means, which encloses a winch provided with a drum on which a flexible suspension element of at least one explosive charge is wound, and programmable control elements, and (b) at least one ignition apparatus for the explosive charge, which is activated by the control elements.

BACKGROUND OF THE INVENTION

To set off avalanches in a safe manner, conveyance apparatus for explosive charges are known, which are transported, until a point above the detonation position, by cable means of a cable transport installation, and which are then set-off by remote control radio or by a timer, or by any other similar system. To bring the explosive charge into contact with the snow mantle, or at a predetermined height above it, these known apparatus generally include a winch which unwinds by inertia. A flexible suspension element, such as a string or a small cable is wound on the winch, which holds the charge during its descent, and which maintains it stationary until the moment of explosion.

During transport, one prevents unwinding of the winch by a retention spring means including a retention string, by which the charge is suspended from the container. When the apparatus has reached the desired location and the control signal for descent is given, an electric ignition apparatus ignites a slow wick, which is connected to the charge and which burns for a duration greater than the duration of descent of the charge. One end of the wick is attached to the retention line, which is destroyed by combustion, such that the weight of the explosive charge is then taken up by the suspension element and the winch, which unwinds the winch.

With such a system, however, the descent of the charge is limited either by contact with the snow or the ground, or by blockage of the winch after unwinding to a preselected length of the suspension element. If one desires to stop the charge at several meters above the snow surface to obtain an optimum explosive effect, it is necessary to determine in advance, the corresponding unwinding length from the height of the transporter cable with respect to the snow. Therefore, this height varies as a function of a number of parameters, particularly the thickness of the snow mantle, the flexing of the transporter cable as a function of the charge, the temperature, the force of the wind, etc. Furthermore, it is necessary to know in detail the profile of the terrain under the cable, as well as the precise position of the apparatus along the length of the cable. In practice, it is difficult to precisely know all of these parameters, and it is almost impossible to evaluate the optimum height at which the explosive charge must be placed above the surface of the snow cover.

SUMMARY OF THE INVENTION

The present invention has thus, an aim to provide a process and apparatus of the type indicated above, which makes it possible to place and maintain an explosive charge at a predetermined height above the surface of the snow so as to propagate a shock wave making it possible to assure an explosion having an optimum effect for setting off an avalanche.

The process according to the invention is advantageous in that one detects the contact between the charge and the snow or the ground by taking-up the slack of the suspension element. One performs in this case, a take-up of the charge by winding up the suspension element until it is tensioned, and one then raises the charge to a predetermined height.

According to a preferred embodiment, to perform this take-up of the charge, one winds up a predetermined length of the suspension element, verifies if the tension in the suspension element exceeds a predetermined threshold, and, if it is not the case, one repeats these operations.

The explosive charge positioning apparatus according to the invention is advantageous in that it comprises a detection apparatus for determining the tension in the suspension element. The detection apparatus is adapted to transmit to the control elements, signals corresponding in value to the tension relative to a predetermined threshold, which is less than the value of the tension caused by the weight of the explosive charge.

The apparatus for detecting the tension in the suspension element, preferably includes at least one mechanical element subjected to the aforementioned tension, and at least one position detector associated with this mechanical element. The mechanical element is adapted to assume a first position when this tension is less than the threshold, and to assume a second position when this tension is greater than this threshold. The mechanical element can be constituted by the winch itself, which is swingably mounted about a pivotable axis. The pivotable axis is horizontally positioned between the center of gravity of the winch and a vertical defined by the suspension element.

Alternatively, the mechnical element is a pulley which is adapted to be in a first position when the tension in the suspension element is greater than the threshold tension and to be in a second position when the tension is less than the threshold tension. The pulley is maintained in the second position by a spring associated with the pulley such that when the tension exceeds the compression force of the spring, the pulley assumes the second position.

According to the preferred embodiment, the position detector is a magnetic detector cooperating with a magnet affixed to the mechanical element. The apparatus may further comprise a magnet mounted on the drum of the winch and a stationary magnetic detector cooperating with the magnet for signaling each turn of the drum. The control elements comprise an electronic unit including at least one microprocessor and memory means for controlling the descent of the charge by registering a number of turns completed by the drum in one direction, and then comparing it with at least one preselected value. The control elements may comprise means, preferably in the form of coded wheels, for selecting and displaying at least one maximum height of descent of the charge, and one height for raising the charge in the situation where it is stopped by the surface of the snow or the ground.

According to another advantageous aspect of the apparatus, the suspension element is provided with a magnet affixed at a safe distance from the explosive charge, and the apparatus is further provided with at least one magnetic detector adapted to signal the control elements the passage of this magnet in a manner so as to maintain at least this safe distance between the charge and the container.

BRIEF DESCRIPTION OF THE DRAWINGS

The invention will be better understood by the description of the preferred embodiment, given below by way of example and with reference to the annexed drawing, in which the single Figure is an exploded perspective view of the apparatus for positioning explosive charges above the surface of snow

DETAILED DESCRIPTION OF THE INVENTION

Figure 1:
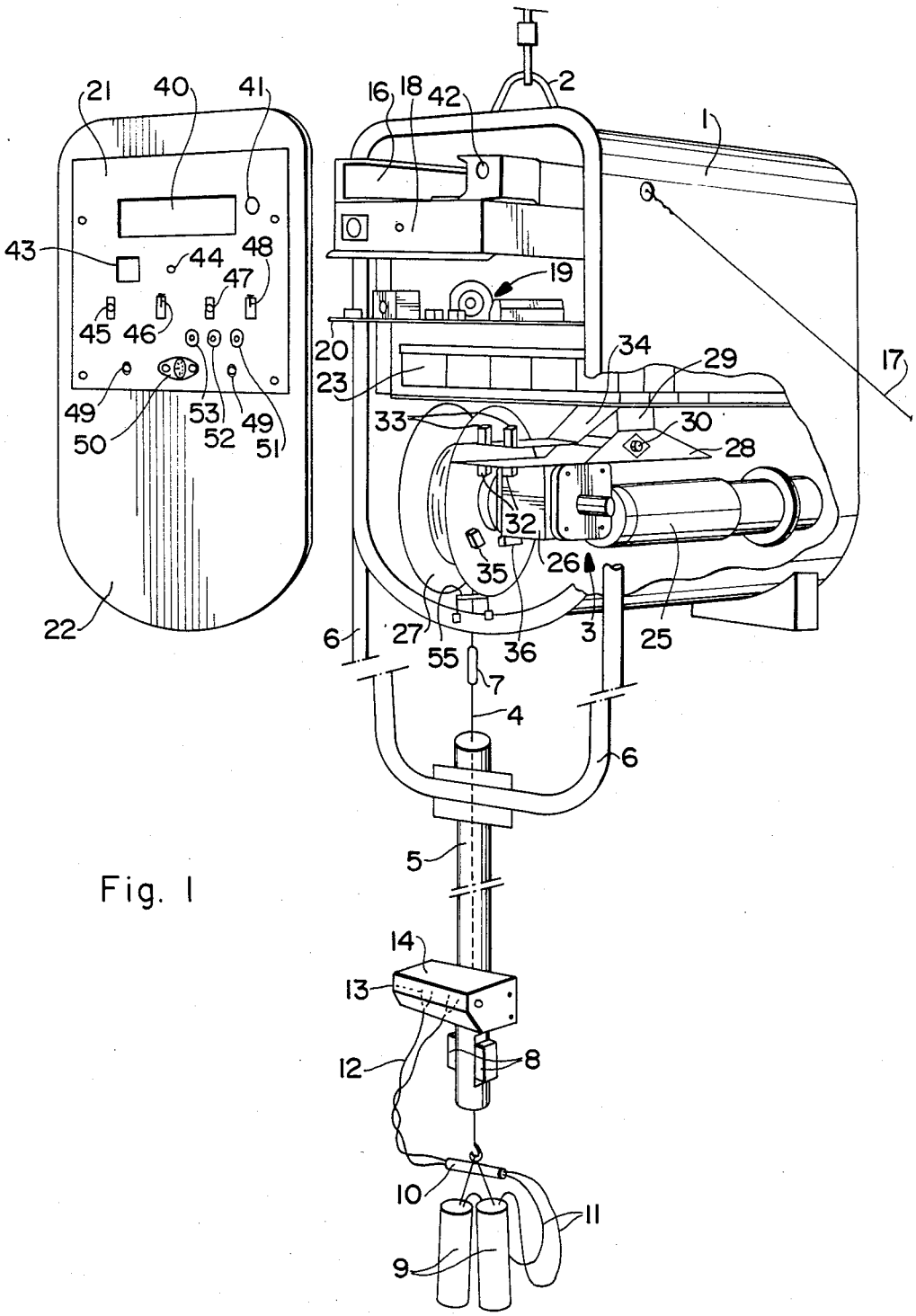

With reference to the Figure, the apparatus comprises a container 1 equipped with a suspension ring 2 to be hung from a cable transport assembly, for example, a rod fixed in a removable manner to a cable circulating on pulleys across one or more avalanche initiation zones. Container 1 encloses an electric winch 3, on which is wound a flexible suspension element 4 which maintains explosive charges 9. In the present case, to support charges which only weigh a few kilograms, suspension element 4 is formed of a string. For heavier charges one may also utilize a small metallic cable, a rope made of synthetic material, etc. Beneath container 1, string 4 passes through a guiding tube 5, which is suspended under the container by suspension means having a metallic stirrup 6, which is journalled thereon. String 4 is provided with a magnet 7 positioned at approximately two meters from its lower end, while two magnetic detectors 8 are positioned on the lower portion of guiding tube 5 to signal the control elements the passage of magnet 7.

The apparatus provided for igniting the explosive charges 9 is of a type well known among these types of apparatus. It comprises an electric ignition means 10 which serves, for example, to ignite two slow fuses 11 respectively, connected to detonators inserted in charges 9. The length of fuses 11 is selected in a manner so as to correspond to a period of time expected to be taken by the charge to descend, as well as to provide an appropriate margin for safety.

By means of a pair of wires 12, electric ignition 10 is removably connected to crocodile clips 1 connected to electric control circuits, and which are positioned in a small box 14 which is open on its bottom. In this manner, wires 12 can be easily removed from clips 13 by lowering of the charges 9.

The upper portion of container 1 encloses control equipment comprising from top to bottom, a sliding chassis 16 adapted to receive a radio receiver associated with an antenna 17 to receive coded control signals; a coder-decoder container. 18 mounted in a slidable manner; a programmable electronic unit 19 comprising a microprocessor and memory means, this unit being mounted likewise on a sliding chassis 20; and, a control panel 21 mounted on a front cover 22 of container 1. The central portion of the container encloses a bank of electric batteries 23, which serve as .a power source for winch 3 and the control elements. The upper and central portions of the container are provided with thermal insulation and heat resistors fed by batteries 23 and controlled by thermostats.

The winch comprises an electric motor 25 having an automatic brake, a reducer having gears 26 and a drum 27 on which is wound string 4, all of the elements are affixed to a pivotable support 28, which is suspended from an element 29 of a portion of the container in a manner so as to oscillate about a horizontal pivot axis 30. The oscillations of the winch around the pivot axis are limited to a certain extent by appropriate abutments (not shown), which are positioned between element 29 and support 28. To detect the position of winch 3, and more particularly, its pivoting movements, two magnets 32, positioned inversely to one another, are affixed to support 28, while two magnetic detectors 33 facing the magnets, are mounted on support 34.

In horizontal projection, the position of pivoting axis 30, is situated between the center of gravity of winch 3 and that of string 4 about drum 27, i.e., the drum 27 has a tendency to rise when string 4 is not loaded. As soon as the tension in string 4 exceeds a predetermined limit, for example, including and between 5 and 10 N, the winch pivots in the opposite direction and drum 27 begins to descend. These respective movements are detected by detectors 33 and transmitted to the control elements.

On the other hand, drum 27 is equipped with a lateral magnet 35 whose passage is detected by magnetic detector 36, so as to count the number of turns of the drum, in relation to the direction of rotation of motor 25. In the example shown, magnetic detectors 8, 33 and 36 are of the ILS type.

In the Figure, control panel 21 is shown in a schematic fashion. It comprises an orifice 40 for the introduction of a radio receptor (not shown), an orifice 41 for an access to a lock 42 for locking the receptor in its chassis, key means 43 for arming decoder 18, an arming confirmation apparatus means 44 for the decoder, and a confirmation apparatus 45 of a 12 volt feed for the control circuits, a stop/start interrupter 46, a 24 volt feed confirmation apparatus 47 for the power circuits, a switch 48 for the manual control of winch 3, fuses 49 for the control and the power circuits, and an outlet 50 for charging batteries 23.

Furthermore, the control panel is equipped with three selection and display devices, i.e., coded wheels 51, 52 and 53, which may be used to program the principle movements of the winch 3 during each use. In operation, the user selects on wheels 51 (with single numerals) and 52 (in increments of 10 units) a maximum height of descent for the charge, in meters. On wheel 53, the user selects a raising height, which corresponds to the desired height of the charge above the surface of the snow at the moment of explosion. The coded wheels 51–53 are connected to electronic control unit 19.

During use, the operation of the apparatus described above is as follows: during transporting the apparatus by means of a cable installation, until it reaches a preselected detonation position, charges 9 and their respective ignition means 10 and 11, are suspended from string 4 in the position shown in the Figure, i.e., in close proximity to the lower end of guiding tube 5. The charges may be protected from adverse weather conditions by a rubber hood (not shown). The crocodile clips are connected to respective ignition terminals in box 14. When the apparatus has reached a desired location where it is vertically aligned with the preselected detonation position, the translation of the apparatus is stopped and the descent may begin.

In the present case, let us assume that the user has preselected on coded wheels 51 and 52, a maximum height of descent of 50 meters, which is greater than the height of the apparatus above the ground at the detonation position, and a raising height of two meters on coded wheel 53. The signal for starting the descent is then given from a distance by the user, by means of a coded radio transmission. This signal is received by the apparatus and decoded by decoder 18 to be transmitted to control unit 19, whose microprocessor automatically controls all of the subsequent operations as a function of the program in memory of the heights selected on the coded wheels 51 and 52, and the indications from magnetic detectors 8, 33 and 36.

In the first place, the microprocessor initiates a timing circuit and establishes the electric feed of ignition 10 for igniting the slow fuses, then it activates electric motor 25 of winch 3, in the direction of descent, which automatically releases the brake associated with the winch. The weight of charges 9 is sufficient for maintaining the string in tension. In the present example, the speed of descent is equal to about 0.6 m/sec.

During rotation of drum 27 of the winch, the microprocessor processes the signals sent by detector 36 on each passage of magnet 35 to count and store in memory the number of turns of the drum. Each turn corresponds, in the example described, to about 33 cm. (about one third of one meter) of length of string 4, such that the number of turns divided by three corresponds to the heights selected on the coded wheels.

During the initial descent phase corresponding, for example, to a height of 3 meters, the indications of detectors 8 and 33 are not considered, such that the descent cannot be interrupted. Thus, after this first phase of descent, magnet 7 is lower than detectors 8, and charges 5 remain sufficiently spaced from container 1 so as to be able to explode without damaging it. For safety reasons, the charges are always automatically descended by at least three meters even if the coded wheels 51 and 52 selected so as to indicate zero.

In accordance with the heights selected in the above example, charges 9 contact the surface of snow or ground before unwinding of string has reached a height of 50 meters, as selected on coded wheels 51 and 52. At this moment, the tension in string 4 becomes very low, and in any case, less than the value which balances the pivot couple of winch 3 under the effect of its own weight. The winch, thus pivots around axis 30 and this movement is signalled to the microprocessor by detectors 33. The microprocessor then stops the winch and verifies that there are no other changes in the state of the winch during a predetermined period, for example, five seconds. In effect, if the charge touches an obstacle, such as a rock, causing it to balance momentarily, a brief interruption in the tension of the string may occur. In such a case, the tension is quickly reestablished and the descent continues.

The charge upon contacting the surface of snow, often penetrates the snow by several decimeters. Furthermore, the flexion of the carrier cable diminishes when it is relieved of the charge. The apparatus according to the invention is, however, adapted to perform a pick-up of the charge before effectively raising the charge above the surface of the snow. To perform such a pick-up, the microprocessor commands a first wind-up operation of string 4 on drum 27 of the winch, for example, over two turns which is 66 cm., then verifies, for example, for five seconds, if detectors 33 have signalled a rocking of the winch, indicating a pick-up of the charge. If this is not the case, it performs a second wind-up operation over two turns, and a third, if necessary. This method of operation makes it possible for winding up to two meters of the string until pick-up of the charge, which is sufficient in all cases to tension the string, begins lifting the charges and compensates for a possible flexion in the carrier cable. From this stage, the microprocessor controls the winch in a manner so as to raise the charge to the preselected height as indicated by the coded wheel 53, then it stops the winch and waits for the explosion of charges 9, resulting from the completion of combustion of fuses 11.

After explosion of the charges, the tension in string 4 falls very low and the winch rocks. The microprocessor commands the winch..to remain in this state for a predetermined period, for example, 20 seconds, then it commands raising of string 4 by number of turns of the drum, which is equal to the number of turns recorded and stored in memory during the descent minus 3 meters. For additional safety reasons, the winch is stopped if detectors 8 signal the passage of magnet 7 affixed to the string. Added safety may be obtained by means of an oblong ring 55 attached to the box below drum 27 for retaining magnet 7, which tensions the string and causes rocking of the winch, which is detected by the microprocessor and detectors 33.

If, for any reason, the explosion does not occur, the winch does not rock and the microprocessor does not detect a change in state. It awaits, for example, 30 minutes, then raises everything as previously described. By virtue of the distance between magnet 7 and explosive charges 9, the latter remain separated by a sufficient distance from container 1, for example, approximately 3 meters, which prevents the container from becoming damaged in case of an accidental explosion.

The apparatus described above, by way of an example of the invention, can obviously undergo various modifications and variations. For example, the winch may preferably be made adjustable in position on its support 28, which allows for modification in the limiting tension of string 4 for pivoting the winch around axis 30, for example, if one is required to replace string 4 by a heavier cable.

The radio apparatus utilized in the present invention can be of the transmitter-receiver type for transmitting from a distance the operator signals representative of the state of operation of the apparatus. Furthermore, one can provide for transmission of various control signals by the operator to the apparatus, particularly, for activating the winch so as to adjust the height of the charges.

According to a simpler embodiment, the apparatus can be operated without radio control, the ignition command then is given by a timer integrated into the electronic control elements.

It is to be understood that the invention is not limited to an apparatus equipped with a pivoting winch, such as described above. In fact, it would suffice for the apparatus to comprise any detection apparatus which contains a tension in the suspension element of the charge. This apparatus can be a force measurement apparatus, for example, of the piezo-electric type, the electronic control apparatus itself performing the tests necessary to determine the state of tension with respect to a predetermined threshold.

According to another embodiment, the detection apparatus can be based on a mechanical element, such as a pulley, on which the suspension element passes, and which is maintained in a first position by a spring. If the tension of the suspension element exceeds a predetermined threshold, its effect exceeds that of the spring and the pulley is thus, brought into a second position. Other apparatus of this type would likewise be obvious to one of ordinary skill in the art.

The cable transport means utilized for transporting the apparatus is not critical in the present invention. In one particular embodiment, the apparatus according to the invention may, for example, be integrated into an automatic transporter circulating on a fixed cable. Such an apparatus can be equipped with a programmable electronic control circuit incorporated into the apparatus, or with an apparatus which is radio controlled, or with a combination of the two systems.

Finally, although the invention has been described with reference to particular means, materials, and embodiments, it is to be understood that the invention is not limited to the particular embodiments disclosed herein and extends to all equivalents thereof within the scope of the claims appended hereto.

What is claimed is:

1. A process for automatically positioning an explosive charge at a predetermined height above the surface of the snow so as to set off an avalanche, comprising the steps of:

(a) positioning said explosive charge above a preselected point on the snow by a cable transport apparatus;

(b) lowering said explosive charge by unwinding a predetermined length of a flexible suspension element connected with said explosive charge;

(c) detecting contact between said explosive charge and the snow or the ground by sensing a reduction in the tension of said flexible suspension element;

(d) lifting said explosive charge by winding said flexible suspension element until it is tensioned; and (e) raising said explosive charge further to a predetermined height.

2. The process of claim 1, wherein lifting of said explosive charge comprises winding a predetermined length of said flexible suspension element, and determining whether the tension in said flexible suspension element exceeds a predetermined threshold.

3. An apparatus for positioning an explosive charge so as to set off an avalanche, comprising:

(a) a container adapted to be carried by a cable transport assembly, .said container enclosing a winch provided with a drum on which a flexible suspension element is wound for suspending at least one explosive charge, and programmable control elements;

(b) means for igniting said explosive charge, said igniting means being activated by said control elements;

(c) means for detecting the tension of said flexible suspension element, said detecting means being adapted to transmit to said control elements signals representing the tension of said flexible suspension element.

4. The apparatus of claim 3, wherein said detecting means comprises at least one mechanical element subjected to said tension and adapted to assume a first position when said tension is less than a threshold tension and a second position when said tension is greater than said threshold tension, and at least one position detector associated with said mechanical element.

5. The apparatus of claim 4, wherein said mechanical element comprises a winch swingably mounted in said container about a pivot axis, said pivot axis being positioned horizontally between the center of gravity of said winch and a vertical plane defined by said suspension element.

6. The apparatus of claim 4, wherein said position detector comprises a magnetic detector positioned in spatial relation to a magnet affixed to said winch.

7. The apparatus of claim 3, further comprising a magnet affixed on a drum of said winch, and a stationary magnetic detector positioned in spatial relation to said magnet for signalling each turn of said drum, said control elements comprise an electronic unit comprising at least one microprocessor and at least one memory means for controlling a descent of said charge by registering the number of turns completed by said drum in one direction and comparing said number of turns with at least one preselected value.

8. The apparatus of claim 7, wherein said control elements comprise means for selecting and displaying at least one maximum height of descent of said charge and a lifting height of said charge.

9. The apparatus of claim 8, wherein said selection and display means each comprises a wheel.

10. The apparatus of claim 3, wherein said suspension element includes a magnet affixed at a predetermined safe distance with respect to said explosive charge, and at least one magnetic detector adapted to indicate to said control elements the passage of said magnet in a manner so as to maintain said safe distance between said charge and said container.

11. The apparatus of claim 10, wherein said magnetic detector is affixed to a guiding tube suspended from said container, said guiding tube being longitudinally traversed by said suspension element.

12. An apparatus adapted to position an explosive charge on the surface of snow for setting off an avalanche, comprising:

(a) a container adapted to be transported to a predetermined explosion site by a cable transport assembly, said container comprising a body portion open at one side and a cover for closing said open side;

(b) means for controlling various functions of said apparatus;

(c) at least one explosive charge and means for suspending said charge from said container, said explosive charge comprising means for tension in said suspending means;

(d) means for igniting said t least one explosive charge, said igniting means being activated by said controlling means; and (e) means for determining said tension in said suspending means, wherein said determining means is adapted to transmit to said controlling means signals corresponding to said tension in said suspending means.

13. The apparatus of claim 12, further comprising a metallic stirrup affixed to the bottom of said container, said stirrup comprising a tube for guiding said suspending means.

14. The apparatus of claim 13, further comprising means for detecting when a predetermined position of said suspending means is reached, said detecting means comprising a plurality of magnetic detectors.

15. The apparatus of claim 14, wherein said igniting means is positioned adjacent to said detecting means on said guidance tube.

16. The apparatus of claim 15, wherein said igniting means comprises:

(a) a plurality of slow fuses, each fuse being connected to a corresponding detonator in said explosive charge;

(b) means for electrically igniting said slow fuses; and (c) a plurality of electric wires, each of said wires including means for connecting a first end of each wire with an electric control circuit, wherein a second end of each said electric wire is connected to said electrically igniting means.

17. The apparatus of claim 12, wherein said controlling means comprises:

(a) a sliding chassis adapted to receive a radio receiver associated with an antenna for receiving control signals;

(b) a coding and decoding assembly slidably mounted on said chassis;

(c) a programmable electronic unit comprising a microprocessor and at least one memory, said programmable electronic unit being slidably mounted on said chassis; and (d) a control panel mounted on an inside surface of said cover.

18. The apparatus of claim 17, wherein said control panel comprises a plurality of height selection devices for selecting a predetermined position of said explosive charge, said position selection devices connected to said programmable electronic unit means.

19. The apparatus of claim 18, wherein at least one of said height selection devices comprises a coded wheel for selecting a maximum height of descent for said explosive charge.

20. The apparatus of claim 19, wherein there are at least two of said coded wheels.

21. The apparatus of claim 18, wherein at least one of said height selection devices comprises a coded wheel for selecting a predetermined position of said explosive charge from the surface of the snow.

22. The apparatus of claim 18, further comprising a key for setting said coder, an arming confirmation apparatus for setting said decoder, and a confirmation apparatus for setting control circuits.

23. The apparatus of claim 14, wherein said determining means comprises a mechanical element subjected to said tension in said suspending means, said mechanical element adapted to be in a first position when said tension is greater than a predetermined threshold tension and adapted to be in a second position when said tension is less than said predetermined threshold tension.

24. The apparatus of claim 23, further comprising a pivotable support member and a stationary support member suspended from said container.

25. The apparatus of claim 24, wherein said mechanical element comprises a winch mounted on said pivotable support member, wherein said winch oscillates between said first and second positions about a horizontal pivot axis, wherein said winch is turned by a motor.

26. The apparatus of claim 25, further comprising a first set of magnetic detectors mounted on said pivotable support member and a second set of magnetic detectors mounted on said stationary support member for detecting the oscillations of said winch.

27. The apparatus of claim 25, wherein a magnet is affixed to the exterior of a drum of said winch, wherein said magnet rotates with said winch such that each passage of said magnet is detected by a magnetic detector located adjacent to said winch and comprises means for counting the number of turns completed by said drum.

28. The apparatus of claim 25, wherein said suspending means comprises a string wound on said winch, the free end of said string passing through said guiding tube and holding said explosive charge by a hook.

29. The apparatus of claim 28, wherein a magnet is positioned on said string at about two meters from the free end of said string, such that when said magnet descends beyond a predetermined point said magnetic detectors detect passage of said magnet and transmit a signal to said controlling means.

30. The apparatus of claim 14, wherein said determining means comprises a pulley, said pulley adapted to be in a first position when said tension is greater than a predetermined threshold tension and adapted to be in a second position when said tension is less than said predetermined threshold tension.

31. The apparatus of claim 30, wherein said pulley is maintained in said second position by a spring associated with said pulley, wherein when said tension exceeds the compression force of said spring, said pulley assumes said first position.

32. The apparatus of claim 12, wherein said controlling means includes at least one timer for automatically setting off said avalanche after a predetermined period of time.

33. A method of positioning an explosive charge at a predetermined height above the surface of snow for setting off an avalanche, comprising the steps of:

(a) transporting an apparatus for setting off an avalanche thereby bringing said charge above a predetermined point of detonation on the snow;

(b) selecting a predetermined position for said explosive charge above said snow;

(c) creating an initial tension in a suspension element to which said explosive charge is attached;

(d) lowering said explosive charge by unwinding a predetermined length of said suspension element from a winch of said apparatus;

(e) detecting contact between said explosive charge and the surface of snow or ground by determining reduction in said initial tension in said suspension element;

(f) stopping unwinding said suspension element;

(g) raising .said explosive charge until said initial tension in said suspension element is resumed; and (h) further raising said explosive charge by a predetermined height.

34. The method of claim 33, further comprising the step of counting and storing in memory the number of turns completed by said winch in step (d).

35. The method of claim 33, further comprising maintaining said tension in said suspension element by the weight of said explosive charge.

36. The method of claim 33, wherein said predetermined length is at least about three meters.

37. A method of setting off an avalanche, comprising the steps of:

(a) transporting an apparatus for setting off an avalanche thereby bringing an explosive charge above a predetermined point of detonation on the snow;
(b) selecting a predetermined position for said explosive charge above said snow;
(c) creating an initial tension in a suspension element to which said explosive charge is attached;
(d) igniting slow fuses;
(e) lowering said explosive charge by unwinding a predetermined length of said suspension element from a winch of said apparatus;
(f) detecting contact between said explosive charge and the surface of snow or ground by determining reduction in said initial tension in said suspension element;
(g) stopping unwinding said suspension element;
(h) raising said explosive charge until said initial tension in said suspension element is resumed;
(i) further raising said explosive charge by a predetermined height;
(j) stopping winding said suspension element;
(k) completing combusting said slow fuses thereby exploding said explosive charge;
(l) determining reduction in said initial tension in said suspension element; and
(m) rewinding said suspension element on said winch after a predetermined period of time.

* * * * *